US007245085B2

(12) United States Patent
Villarin

(10) Patent No.: US 7,245,085 B2
(45) Date of Patent: Jul. 17, 2007

(54) LAMP FAULT DETECTOR

(76) Inventor: Nilo L. Villarin, 11300 Seneca View Way, Great Falls, VA (US) 22066

( * ) Notice: Subject to any disclaimer, the term of this patent is extended or adjusted under 35 U.S.C. 154(b) by 32 days.

(21) Appl. No.: 11/101,664

(22) Filed: Apr. 5, 2005

(65) Prior Publication Data

US 2005/0253532 A1 Nov. 17, 2005

Related U.S. Application Data

(60) Provisional application No. 60/559,577, filed on Apr. 5, 2004.

(51) Int. Cl.
*H05B 37/00* (2006.01)

(52) U.S. Cl. ..... 315/188; 315/362; 315/240; 315/315; 307/132 R; 307/132 E

(58) Field of Classification Search ..... 315/323, 315/324, 322, 320, 317, 313, 312, 185 R, 315/187, 188, 189, 362, 228, 240, 241 R, 315/314, 315; 307/132 R, 132 E
See application file for complete search history.

(56) References Cited

U.S. PATENT DOCUMENTS 4,536,695 A * 8/1985 Lin ..... 320/136
5,886,423 A * 3/1999 Gershen et al. ..... 307/36
6,518,707 B2 * 2/2003 Gershen et al. ..... 315/129
6,765,313 B2 * 7/2004 Janning ..... 307/36

* cited by examiner

*Primary Examiner*—Thuy V. Tran
*Assistant Examiner*—Dieu Hien Duong
(74) *Attorney, Agent, or Firm*—Ronald H. Shubert

(57) ABSTRACT

The continuity of a series-wired, lamp circuit is restored after interruption caused by failure of a lamp filament by providing a control relay that is wired in parallel with each lamp. A power resistor having a resistive load substantially the same as that of a lamp filament is arranged in series with the relay contacts, which are normally open. The failure of a lamp filament causes a high voltage to be impressed across the coil of the relay, causing it to pick up and its contacts to close, thus substituting the resistor for the lamp filament and restoring continuity to the circuit.

15 Claims, 2 Drawing Sheets

LAMP FAULT DETECTOR

REFERENCE TO RELATED APPLICATION

This application claims the benefit of U.S. Provisional Patent Application No. 60/559,577 that was filed Apr. 5, 2004.

BACKGROUND OF THE INVENTION

1. Technical Field

This invention relates to a method and means for restoring the continuity of the circuit of two or more series connected filament lamps whenever one lamp filament opens.

2. Description of Related Art

Lamps that form a part of an extensive array, such as airport guidance and runway lights, are frequently arranged in small groups of two or more that are series connected. That arrangement is advantageous as it is more economical to install than is a parallel connected lamp array. However, the series connected lamp groups have the disadvantage that if the filament of one lamp in the group fails, the other lights within the group go dark.

It is known in the prior art to use a solenoid in combination with a toggle switch, or a circuit breaker in combination with a micro switch, to bridge the opened lamp filament and thereby maintain operation of the remaining lamps in the group. That approach can only be used with a constant current source supplying the lamp group otherwise the remaining lamps within the group will be subjected to a damaging over-voltage. The controllers for constant current sources are slow to respond, or ramp down, to the preset current level when a portion of the resistive load, in this case a lamp filament, is suddenly removed. That slow response time subjects the remaining lamps within a group to over-voltages of significant magnitude that may last for several seconds. For example in a three-lamp group as one filament is bridged, the over-voltage jumps to approximately 150% of the rated lamp voltage and then decreases to the rated lamp voltage as the controller ramps down.

Advantages provided by use of this invention include the prevention of over-voltage damage to a series connected group of filament lamps by instantly substituting a resistor in place of an opened lamp filament; allowing the use of a constant voltage rather than a constant current source; and obtaining substantial cost savings.

SUMMARY OF THE INVENTION

This invention comprises a means and a method for preventing over-voltage damage and restoring circuit continuity to a group of two or more series connected filament lamps upon the opening or failure of one lamp filament so as to allow the remaining lamps within the group to continue to light. A first embodiment comprises an arrangement that includes a control relay, diode rectifiers, a dropping resistor, a filter capacitor and a power resistor is provided for each lamp within a group. In a second embodiment, the individual diode rectifiers are replaced with a single bridge rectifier at the input and the individual filter capacitors are replaced by a single filter capacitor. In each embodiment, the resistance value of the dropping resistor is set so that the control relay will not pick up during normal operation when all lamps are functional but will pick up when a lamp filament is opened and will not drop out or release after circuit continuity is reestablished.

DESCRIPTION OF PREFERRED EMBODIMENTS OF THE INVENTION

Figure 1:
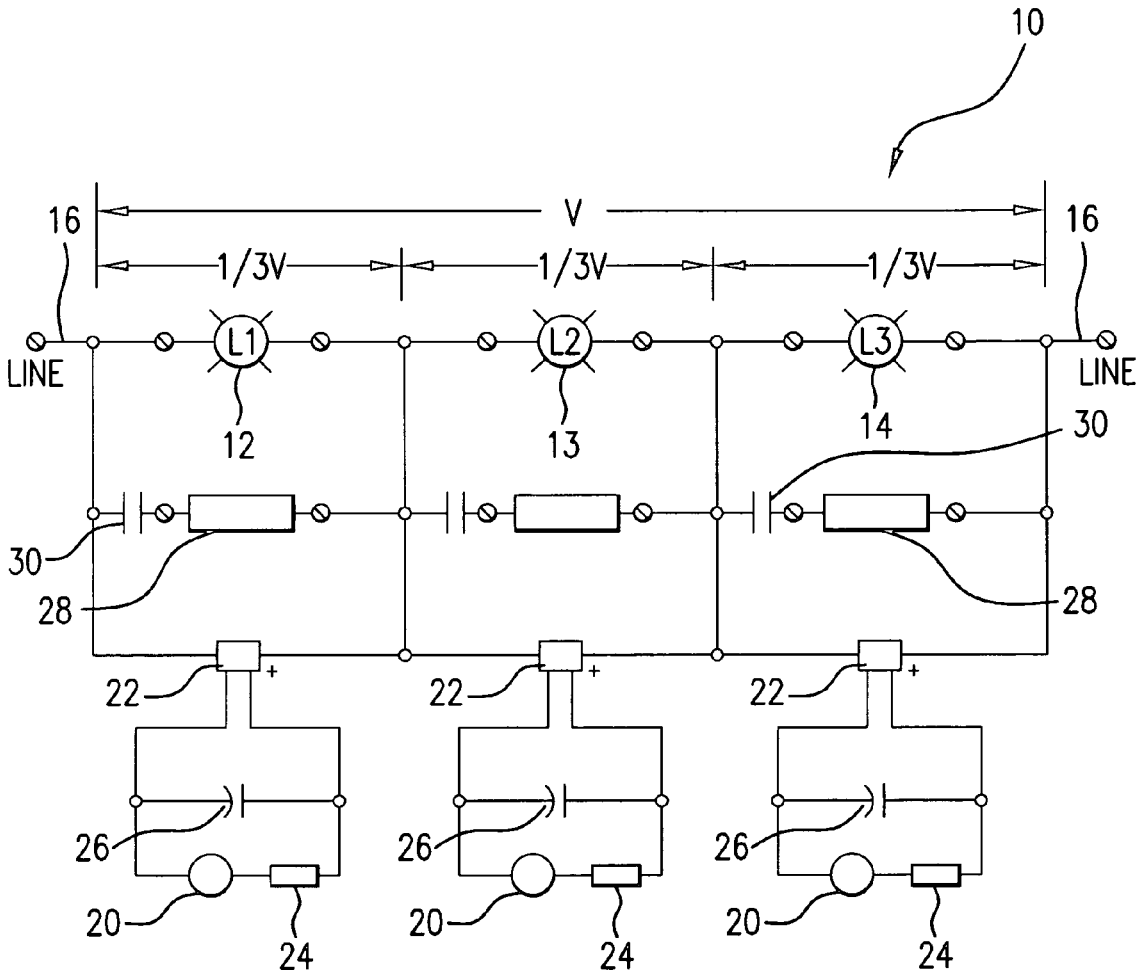
FIG. 1 is a circuit diagram showing a grouping of three series connected, filament lamps; each lamp associated with the lamp fault detector and circuit continuity restorer of this invention.

This invention will be described referring first to FIG. 1. That Figure depicts generally at 10 a group of three series connected filament lamps 12, 13, and 14 that are each arranged in cooperation with a circuit restoration means according to this invention. The lamps are connected to an electrical source by way of line 16 which is at voltage V. The electrical source preferably is of constant voltage. Because the lamps are connected in series, the voltage drop across each lamp is 1/3V as is illustrated in the diagram.

One restoration means is associated with each lamp and each functions to assure that in the event one lamp filament opens, the two remaining lamps will continue to burn at rated voltage without danger of over-voltage damage. Each circuit restoration means comprises a control relay 20, a diode rectifier 22, a dropping resistor 24, a filter capacitor 26 and a power resistor 28. Under normal operating condition, the voltage across the diode rectifier 22 and across each of the lamps is equal at 1/3V.

When the filament in one lamp, lamp 12 for example, fails the full source voltage V is impressed across the diode rectifier 22 resulting in a corresponding high voltage across the coil of control relay 20. That high voltage causes relay 20 to pickup and to immediately close relay contacts 30. Closure of contacts 30 inserts power resistor 28 in place of the open filament and returns the voltage across diode rectifier 22 to its initial value of 1/3V. Control relay 20 is arranged so that its drop out voltage is below the normal voltage across a lamp filament, and so the relay will not release upon the closure of contacts 30. Relay 20 will drop out when the electrical supply 16 is turned off and the line voltage is reduced to zero during replacement of lamp 12. The relay will not pick up upon restoration of power because its pickup voltage is higher than is the voltage drop across a lamp.

Figure 2:
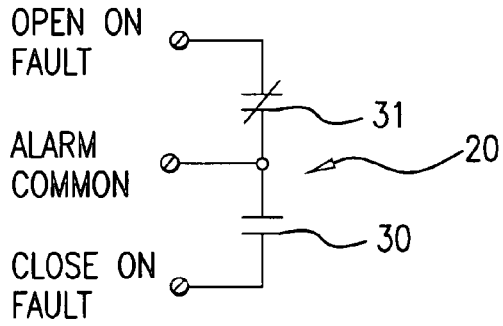
FIG. 2 is a detail operational view of the control relay contact arrangement used in the system illustrated in FIG. 1.

Referring now to FIG. 2, there is shown a portion of the control relay 22 including the relay contacts 30. As is shown in the drawing, relay 22 includes a pair of contacts 30 and 31. In the event that a filament in any one of the lamps fails, relay 22 picks up and nearly instantaneously closes contacts 30 which substitutes power resistor 28 in place of the failed lamp filament and restores circuit continuity. Contacts 31 simultaneously open sending an alarm signal indicating that a lamp needs replacement.

Figure 3:
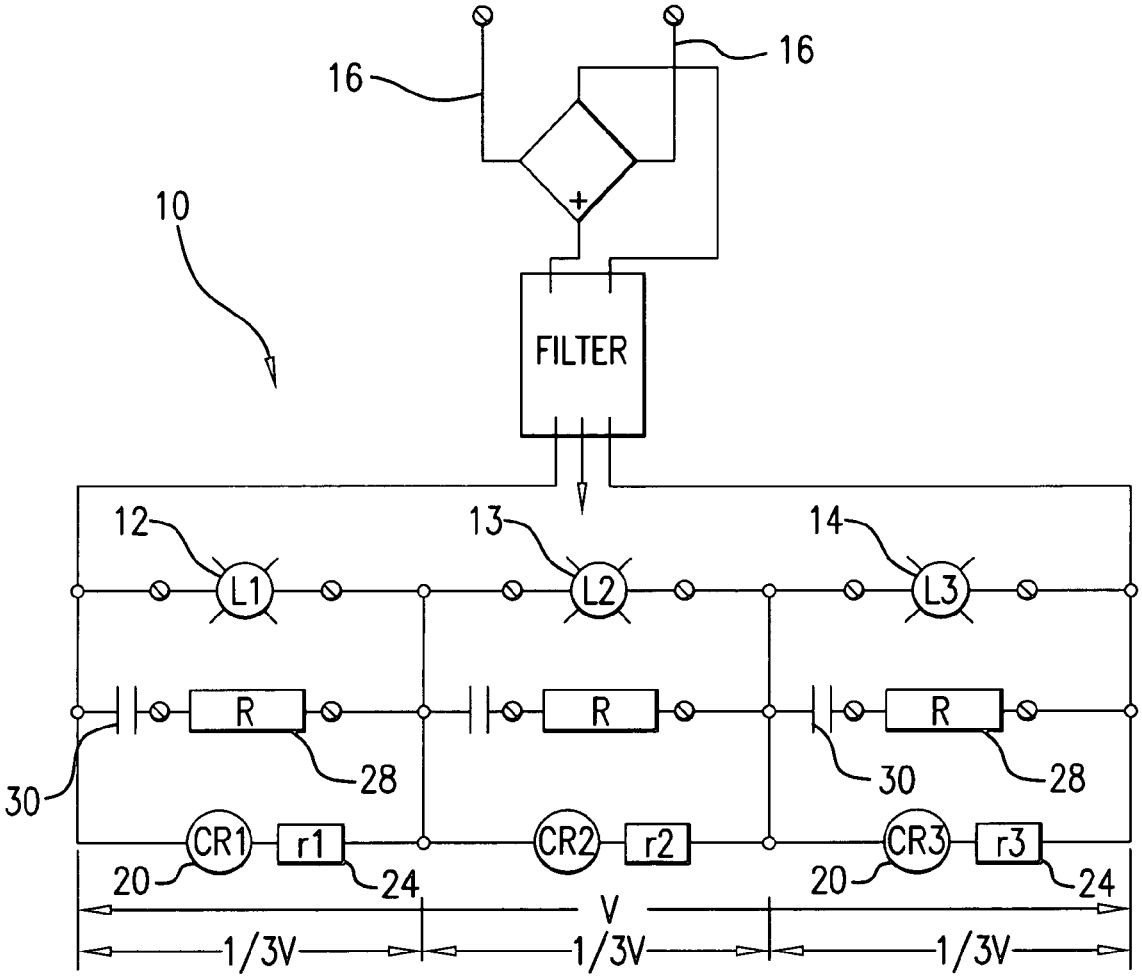
FIG. 3 is a second embodiment of the circuit continuity restorer of FIG. 1.

The sequence of operation of the FIG. 3 embodiment is the same as that described in relation to FIGS. 1 and 2. In this embodiment, however, the individual rectifiers 20 of FIG. 1 are replaced with a single bridge rectifier 35. Rectifier 35 is followed by a single filter capacitor 37 that replaces individual filter capacitors 26 of the previous embodiment. Use of a silicon controlled rectifier is preferred to convert the electrical supply from ac to dc because that results in smoother voltage and current waveforms, and eliminates the chopped up voltage spikes that contribute to premature lamp burnout.

While the invention has been particularly described in an embodiment employing three lamps, it is equally suited for use with groups of 2, or with groups of four or more, series connected filament lamps.

I claim:

1. A means for restoring the continuity of a series connected, filament lamp circuit after one lamp filament opens, comprising:

a plurality of series connected, filament lamps;

a control relay in parallel with each of said lamps, the contacts of said relay being normally open when all lamps are burning;

a power resistor in series with the contacts of each said relay, said power resistor arranged to provide a resistive load that is substantially the same as that of a lamp filament; and a second resistor in series with each of said control relays, the resistance value of said second resistor set so that said control relay will not pick up and close said contacts when all lamps in said circuit are functional, but will pick up when a lamp filament opens and imposes a high voltage across said second resistor to thereby substitute said power resistor for said opened lamp filament and restore the continuity of the circuit.

2. The means of claim 1 wherein an alternating current is supplied to said lamp circuit and wherein said means for restoring lamp circuit continuity includes a rectifier and filter capacitor.

3. The means of claim 2 wherein one said rectifier and filter capacitor is provided for each said control relay, and wherein said rectifier is arranged to provide direct current to said control relay and dropping resistor.

4. The means of claim 3 wherein said rectifier is a diode rectifier.

5. The means of claim 1 including a single bridge rectifier at the input to said lamp circuit to convert an alternating current electrical source to direct current.

6. The means of claim 5 wherein said rectifier is a silicon controlled rectifier.

7. The means of claim 1 wherein said lamp circuit includes three lamps.

8. The means of claim 1 wherein said control relay is provided with a second set of contacts, said second contacts arranged to send an alarm signal indicating a lamp failure upon substitution of said power resistor for said opened lamp filament.

9. A means for restoring the continuity of a series connected, filament lamp circuit after one lamp filament opens, comprising:

a plurality of series connected, filament lamps;

a control relay and a filter capacitor in parallel with each of said lamps, the contacts of said relay being normally open when all lamps are burning;

a power resistor in series with the contacts of said control relay, the resistance value of said power resistor arranged to provide a resistive load that is substantially the same as that of a lamp filament;

a rectifier to supply direct current to said control relay and filter capacitor; and a second resistor in series with the each said relay, the resistance value of said second resistor being set such that the control relay will pick up and close the contacts of said control relay upon the imposition of a high voltage caused by the opening of a lamp filament, thereby substituting said power resistor for said opened lamp filament and restoring continuity of the circuit.

10. The means of claim 9 wherein said lamp circuit includes three lamps.

11. The means of claim 9 wherein said control relay is provided with a second set of contacts, said second contacts arranged to send an alarm signal indicating a lamp failure upon substitution of said power resistor for said opened lamp filament.

12. A means for restoring the continuity of a series connected, filament lamp circuit after one lamp filament opens, comprising:

a plurality of series connected, filament lamps;

means for supplying direct current to said lamp circuit;

a power resistor and the contacts of a control relay in parallel with each of said lamps, the contacts of said relay being normally open when all lamps are burning, the resistance value of said power resistor selected to provide a resistive load that is substantially the same as that of a lamp filament;

a second resistor and the coil of said control relay in parallel with each of said lamps, the resistance value of said second resistor being set such that the control relay will pick up and close the contacts of said control relay upon the imposition of a high voltage across the relay coil caused by the opening of a lamp filament, thereby substituting said power resistor for said opened lamp filament and restoring the continuity of the circuit.

13. The means of claim 12 including a bridge rectifier and filter capacitor arranged to supply direct current to said lamp circuit.

14. The means of claim 12 wherein said control relay is provided with a second set of contacts, said second contacts arranged to send an alarm signal indicating a lamp failure upon substitution of said power resistor for said opened lamp filament.

15. The means of claim 12 wherein said lamp circuit includes three lamps.

* * * * *